United States Patent [19]

Eklund et al.

[11] 4,033,227

[45] July 5, 1977

[54] MAGAZINE SPECIALLY INTENDED FOR TANK WITH LARGE-CALIBRE FIREARM

[75] Inventors: John Folke Eklund; Sven-Håkan Svensson, both of Karlskoga, Sweden

[73] Assignee: AB Bofors, Bofors, Sweden

[22] Filed: Sept. 25, 1975

[21] Appl. No.: 616,519

[30] Foreign Application Priority Data

Oct. 18, 1974 Sweden ..... 7413124

[52] U.S. Cl. ..... 89/34; 89/36 H; 89/47

[51] Int. Cl.² ..... F41H 7/06

[58] Field of Search ..... 89/33 A, 34, 36 H, 36 K, 89/40 B, 45, 46, 47

[56] References Cited

UNITED STATES PATENTS

| | | | |
|---|---|---|---|
| 1,002,169 | 8/1911 | McSweeney | 89/36 H |
| 2,594,198 | 4/1952 | Motley | 89/36 K |
| 2,608,135 | 8/1952 | Aldrin | 89/45 |
| 2,690,700 | 10/1954 | Turner | 89/36 H |
| 3,238,845 | 3/1966 | Christiansson | 89/46 |
| 3,500,718 | 3/1970 | Stoner | 89/33 A |
| 3,911,787 | 10/1975 | Seibel | 89/34 |
| 3,937,125 | 2/1976 | Eriksson | 89/45 |

FOREIGN PATENTS OR APPLICATIONS

| | | | |
|---|---|---|---|
| 150,980 | 12/1920 | United Kingdom | 89/40 B |

*Primary Examiner*—Stephen C. Bentley
*Attorney, Agent, or Firm*—Pollock, VandeSande & Priddy

[57] ABSTRACT

A magazine, for use on a tank having a large calibre firearm thereon, takes the form of a magazine body which is separate from the tank chassis and which is freely suspended low on the tank on the outside of the tank chassis at the rear end of the tank.

20 Claims, 9 Drawing Figures

MAGAZINE SPECIALLY INTENDED FOR TANK WITH LARGE-CALIBRE FIREARM

Figure 1:
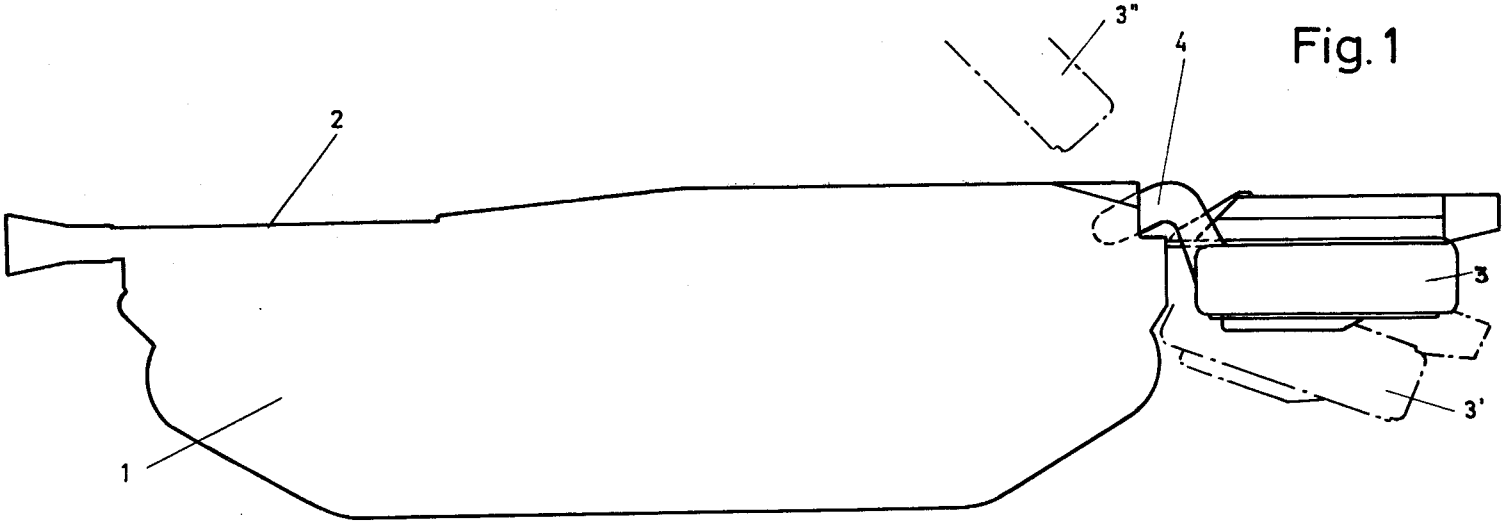

The present invention relates to a magazine specially intended for a tank with a large-calibre firearm. As an example of such firearms can be mentioned a 105 mm high-pressure gun.

For magazines on tanks, of the kind in question, the endeavour has been, as a rule, to have the magazine placed low, at the same time as it has been endeavoured to give the magazine an embodiment and a position where the effect of a powder fire in the magazine on the vital parts of the tank and crew can be kept as low as possible.

However, such a location and design of the magazine often infringes on the possibilities for the disposition of other functions within the tank, and therefore, in certain cases, in spite of the risk for hits, it can be necessary to have the magazine in parts of the tank that are subjected to enemy fire to a greater extent.

The purpose of the present invention is to attack these problems in a radical way, and to go all the way as regards the exposure of the magazine to enemy fire, and in accordance therewith it is proposed that the magazine be made as a component separated from the tank chassis which is suspended on the outside of the chassis via one or several fastening members in the form of arms or corresponding means.

Particularly in the case of a tank which has the firearm applied so that its rear parts are located at the rear section of the tank, in a further development of the concept of the invention, the externally positioned magazine can be given a relatively protected place on the tank by being suspended in fastening members entirely behind the rear part of the tank. In a still further development in conjunction with this location, the magazine is made with covers that can be blown out in directions which can be considered to be harmless to the other functions of the tank. By dividing the magazine into different compartments, the magazine can not only be designed for ammunition of different kinds, but can also be made to function after a fire in the magazine, inasmuch as the fire occurs only in one compartment.

The maneuverability and loading effectiveness of a tank utilizing the invention need not be neglected in any way, as the fastening means for the magazine can be made jointed so that the magazine is pressed upwards when it hits the ground, objects on the ground etc., when driving in rough terrain.

An embodiment proposed at present which has the characteristics significant for the invention will be described in the following, with reference to the accompanying drawings, in which FIG. 1 in a vertical view shows the fastening means in principle, for the magazine on a tank on which it is applied, FIG. 2 in a horizontal view shows the tank according to FIG. 1, FIG. 3 in a vertical view and in detail shows a fastening member for the magazine, FIG. 4 in a horizontal view shows the fastening member according to FIG. 3, FIG. 5 in a vertical view and in cross-section shows the magazine and parts of the tank, FIG. 6 in a horizontal view and partly in cross-section shows the magazine and the tank according to FIG. 5, FIG. 7 in a vertical view shows the magazine in a view which is turned 90° in relation to the view according to FIG. 5, FIG. 8 in a horizontal view and in cross-section shows the magazine according to FIG. 7, and FIG. 9 in a vertical section shows a view of the magazine according to FIG. 8.

In the figures, parts corresponding to each other have been given the same reference designations.

Figure 2:
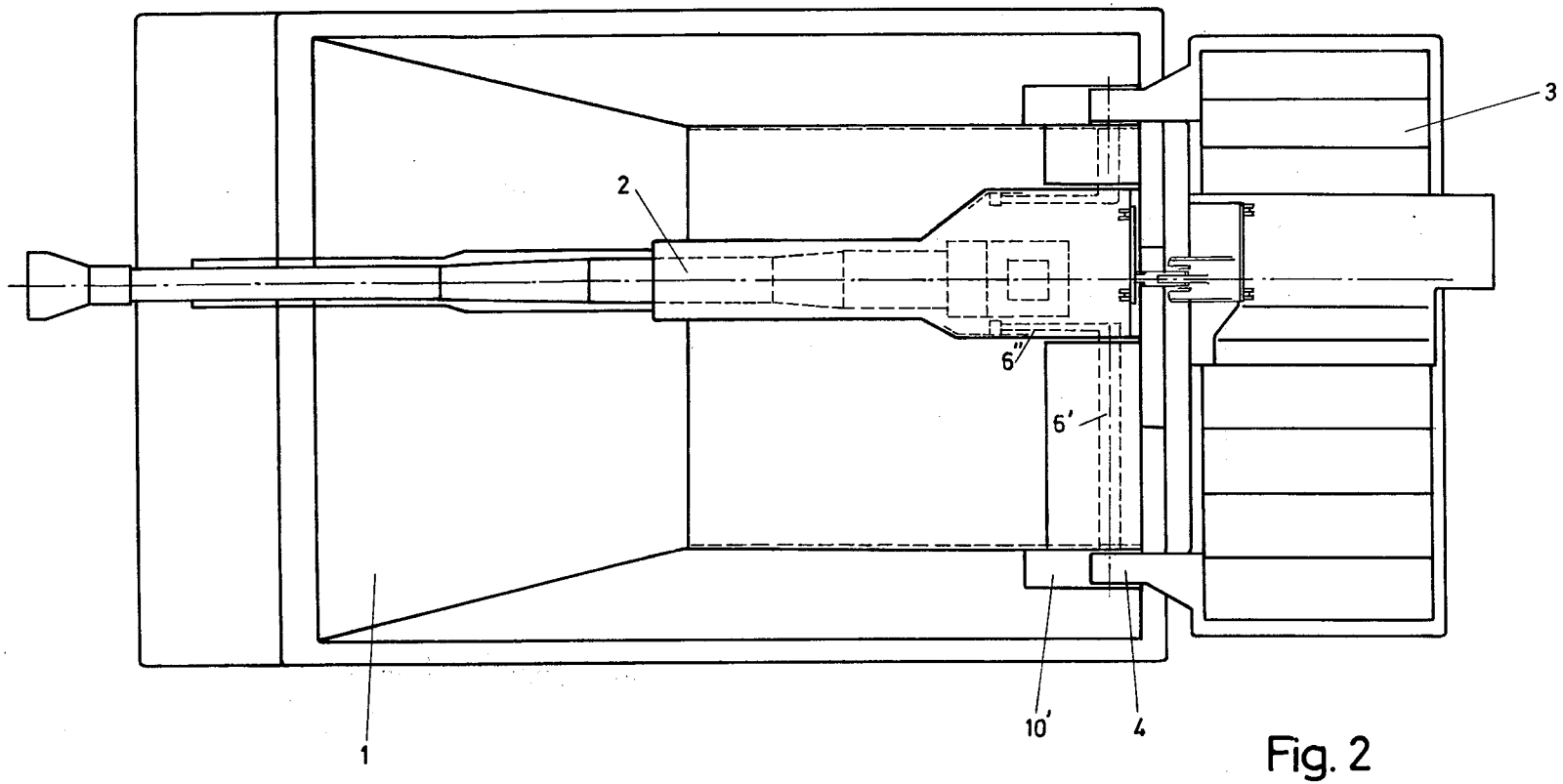

In FIGS. 1 and 2, a tank is designated 1 and the firearm of the tank bears the designation 2. The tank is of the kind which has the firearm supported so that its rear parts are located at the rear section of the tank. The elevation of the firearm is carried out in a way which is known in itself for the type of tank. Traversing of the firearm is carried out by turning the entire tank. Separated from the tank chassis, a magazine 3 is arranged on the outside of the tank chassis, suspended in fastening members 4. The magazine 3 protrudes entirely outside the tank chassis, and extends behind this along the major portion of the width of the tank. In the present case, the fastening members 4 consist of two arms which respectively are rigidly fastened to the magazine and flexibly arranged to the tank. The magazine 3 is intended to follow the elevation and depression movements of the weapon 2, but at the same time the fastening is carried out in such a way that the magazine is jointed in relation to the barrel of the firearm if, for instance, the magazine hits the ground. The fastening members 4 can moreover be controlled, so that the magazine 3 can be raised when driving in rough terrain, when putting up a collapsible flotation screen etc. The designation 3′ is intended to show the position of the magazine when the firearm is in the maximum elevation that can be accomplished by means of the elevation system of the tank, and the designation 3″ depicts the position of the magazine 3 when the magazine is raised.

Figure 3:
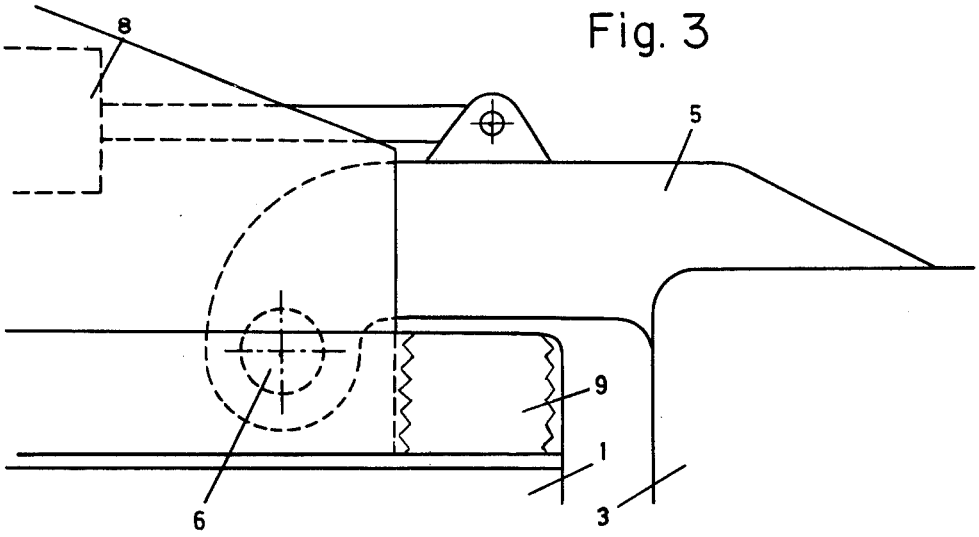
Figure 4:
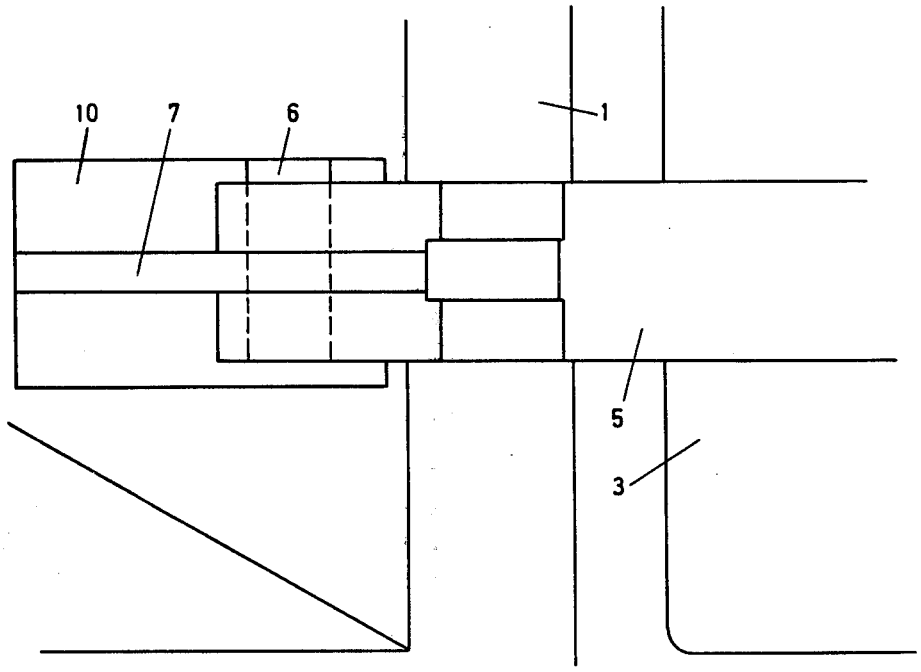

FIGS. 3 and 4 are intended to show an example of a fastening member for the magazine in more detail, and the example differs from what is shown in FIGS. 1 and 2. In the example, the fastening member is made in the form of an arm, and the respective arm 5 has one end fastened by means of welding or the like to the other parts of the magazine 3. The arm 5 consists of a stiff spring, standing on end, which is curved in the plane of FIG. 3. At its other end, the arm 5 is rotatably supported on a shaft 6, which is fixed to the tank chassis. At its middle, on its upper side, the arm 5 is fastened to a piston 7 in a hydraulic cylinder 8. The position of the cylinder 8 in relation to the fastening of the arm is such that, by controlling the piston 7 the arm 5 can be actuated to raise and lower the magazine 3 in relation to the chassis 1. The supporting shaft 6 is located inside a collapsible flotation screen 9 on the tank, so that the magazine can be drawn inside the screen 9 when this is to be used. The shaft 6 is located in a recess 10 which emerges at the upper side of the tank, and into which the arm 5 thus goes down for coaction with the shaft 6. The recess 10 is made so that pivoting of the arm 5 by means of the hydraulic cylinder 8 can take place.

As shown in the example of the fastening member according to FIGS. 1 and 2, the coordination to the elevation and depression movements of the firearm can be carried out in that the shaft 6′ is rigidly supported in the arm 4 and connected with an angular part 6′ which extends from the shaft 6′ and which is fastened to the firearm 2 so that the inclination of the magazine 3 can be determined depending on the inclination of the firearm 2. Also in this case, the fastening members are supported in a recess which in this case has been designated 10′ (see FIG. 2).

Figure 5:
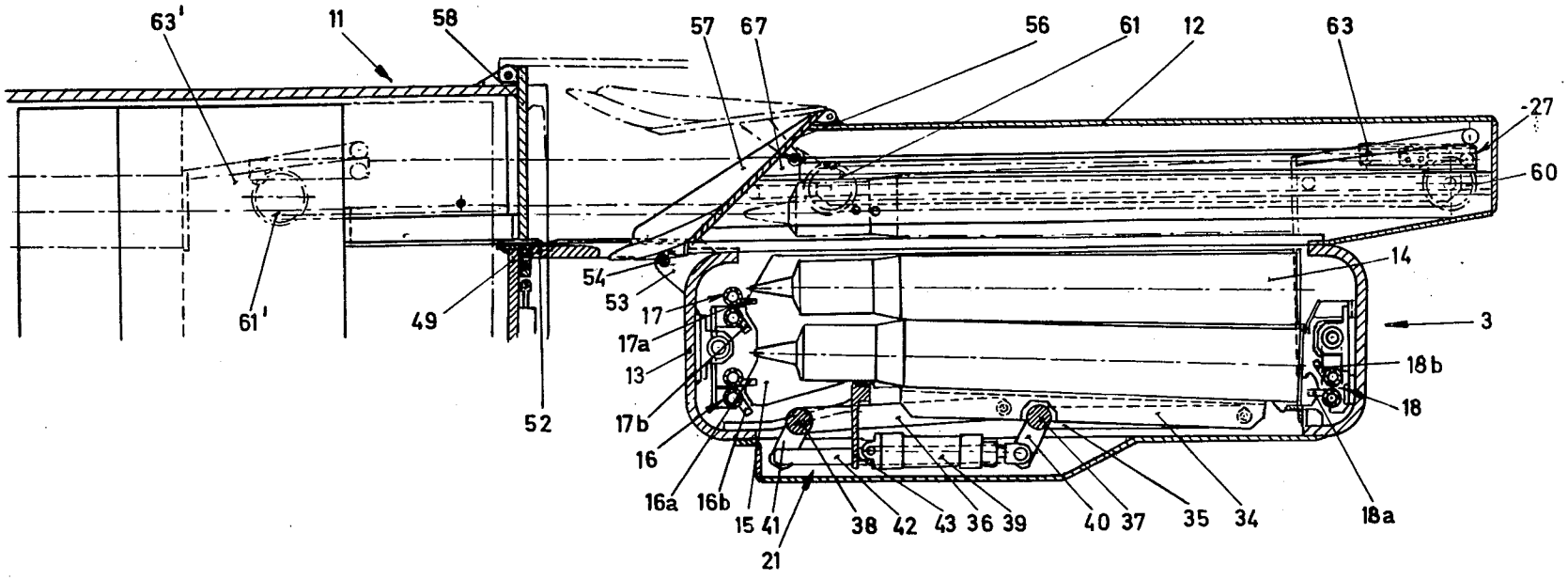
Figure 6:
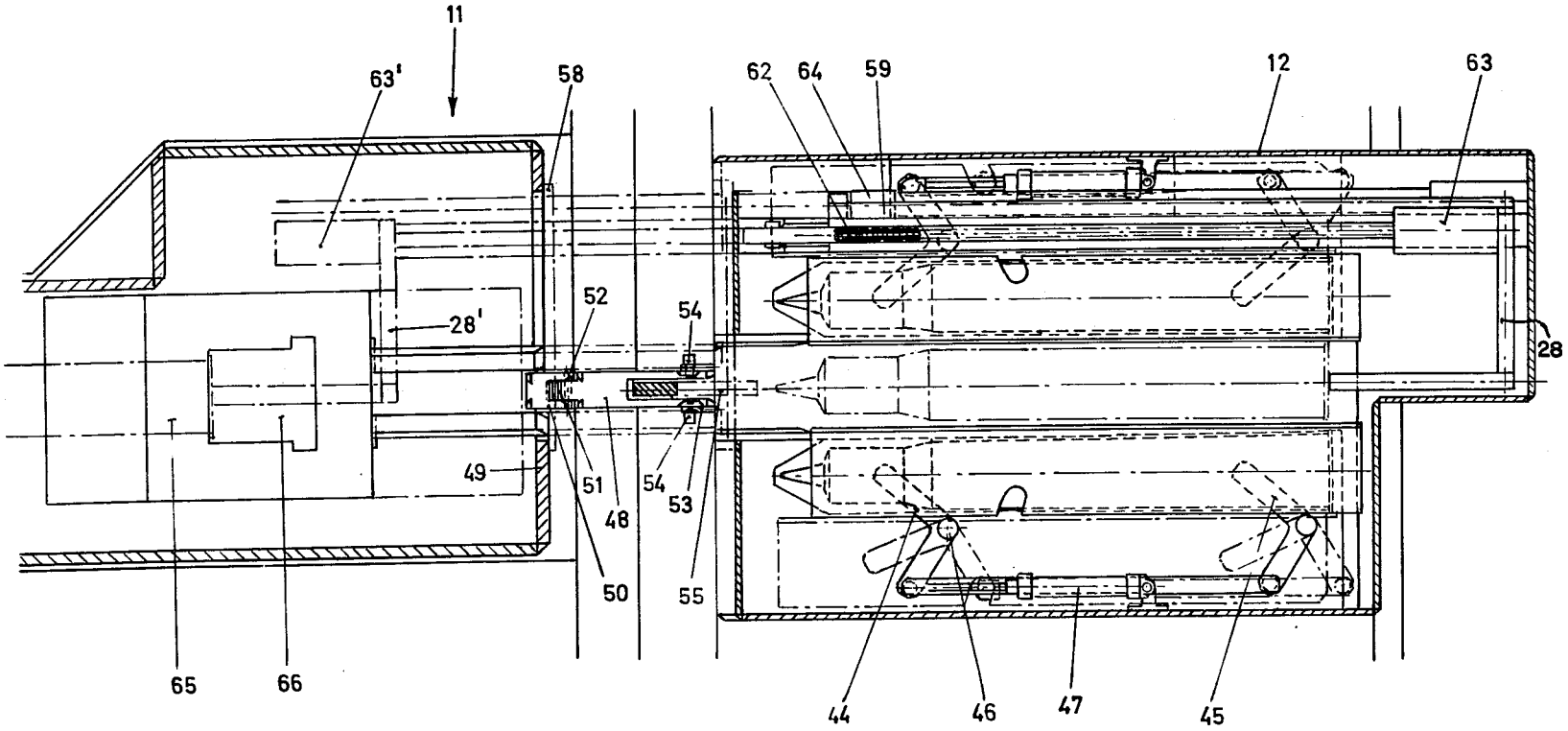

FIGS. 5 and 6 show a section at the rear parts 11 of the firearm. In this section, the magazine 3, on its upper side, is provided with a built-on part or housing 12. The actual magazine consists of a rigid frame 13 arranged on end, which is made of armour plate with a thickness within the range of 15–100 mm. The sides of the magazine frame are given a greater thickness than the front and rear ends thereof, and said relations can be, for instance, 50 and 30 mm, respectively. The magazine is intended to contain two rows of rounds 14, arranged one over the other, which are placed in the magazine in columns of two and two. The columns of rounds are separated from each other by means of intermediate walls 15, in the form of plates, which can be displaced laterally. The ammunition transport takes place by means of said plates 15, which are steered up and displaced laterally by means of hydraulically controlled step-feeding members 16, 17 and 18, which step-feeding members are coordinated with each other and comprise holding and feeding teeth. The holding teeth (shown in greater detail FIG. 9) are designated 16*a*, 17*a* and 18*a*, and are applied on a common bar, extending in the longitudinal direction of the magazine (i.e., a direction at right angles to the plane of FIG. 5) which bar can be actuated between two different end turning positions. In one of the end turning positions, the holding teeth are in coaction with the respective sections of the separating wall plates 15, and in the other end turning position the holding teeth are released from said plates. The feeding teeth 16*b*, 17*b* and 18*b*, are also applied on a bar, likewise extending in the longitudinal direction of the magazine 3 which, in addition to being rotatable, can also be displaced in the longitudinal direction. This bar can also be turned between two end positions, and in one of the end positions the teeth are in coaction with respective sections of the separating walls 15, and in the other end position are released from the separating walls 15. Said displacement movements move the feeding teeth one step forwards and back. By controlling said bars, the lateral displacement can take place by means of the teeth 16*b*, 17*b* and 18*b*, and holding takes place by means of the teeth 16*a*, 17*a* and 18*a* when the feeding teeth are to return to a new fetching position. Said arrangement with holding and feeding teeth is known in itself. Said bars are placed so that two pairs are applied in front of the points of the rounds and one pair behind the flanges of the cartridge cases of the round.

Figure 7:
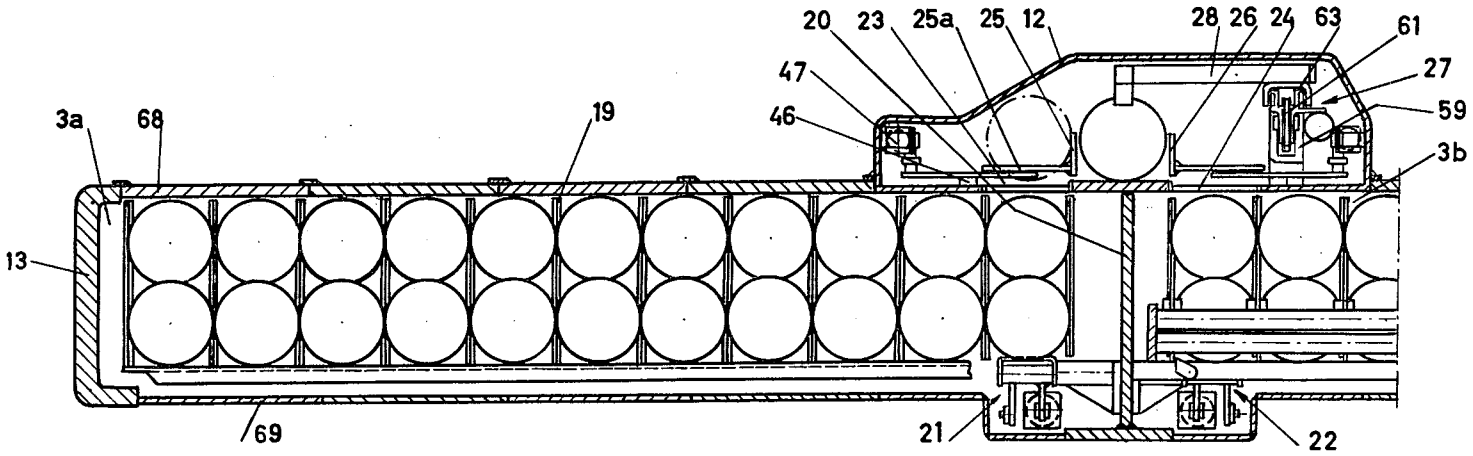
Figure 8:
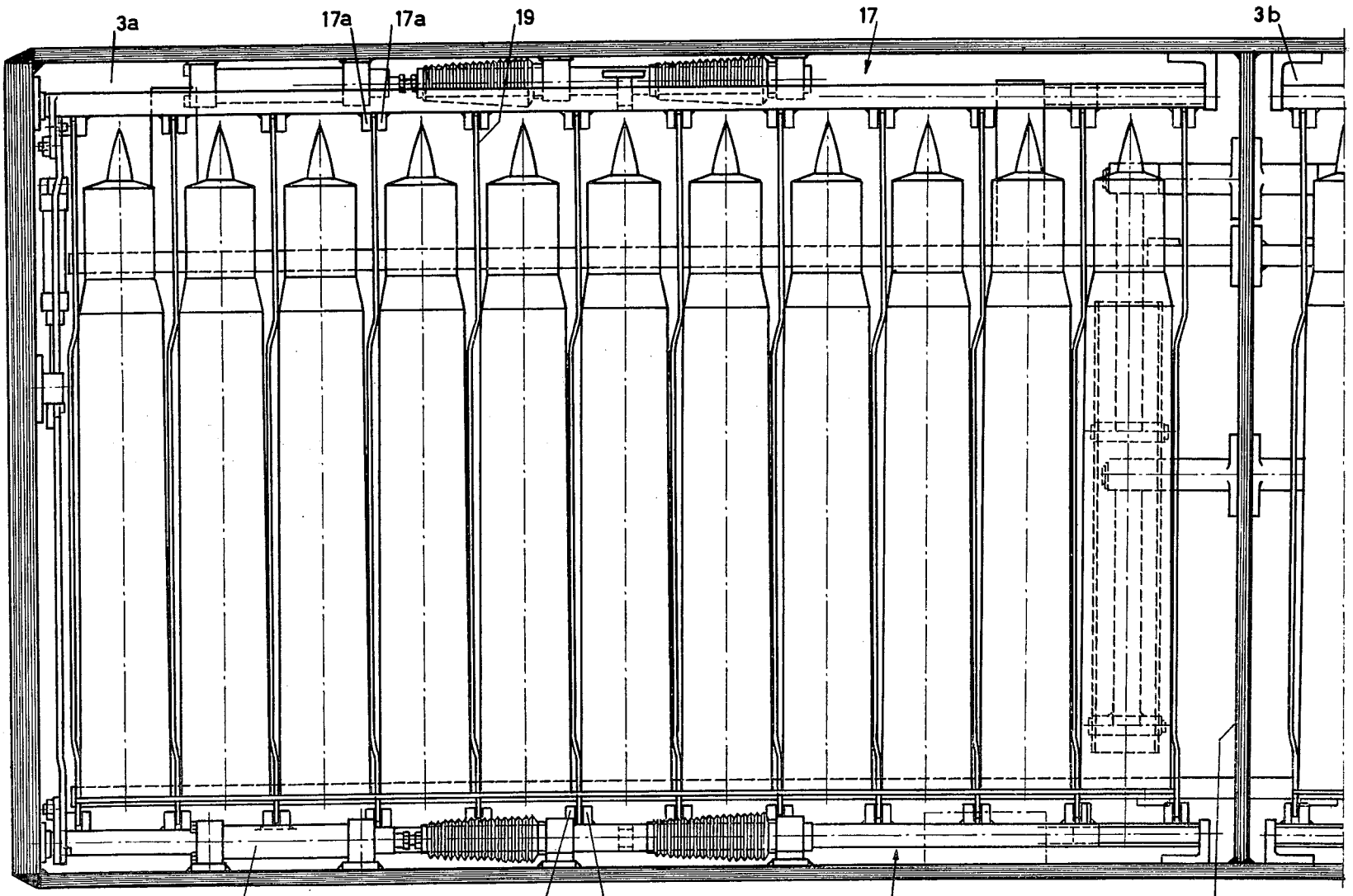
Figure 9:
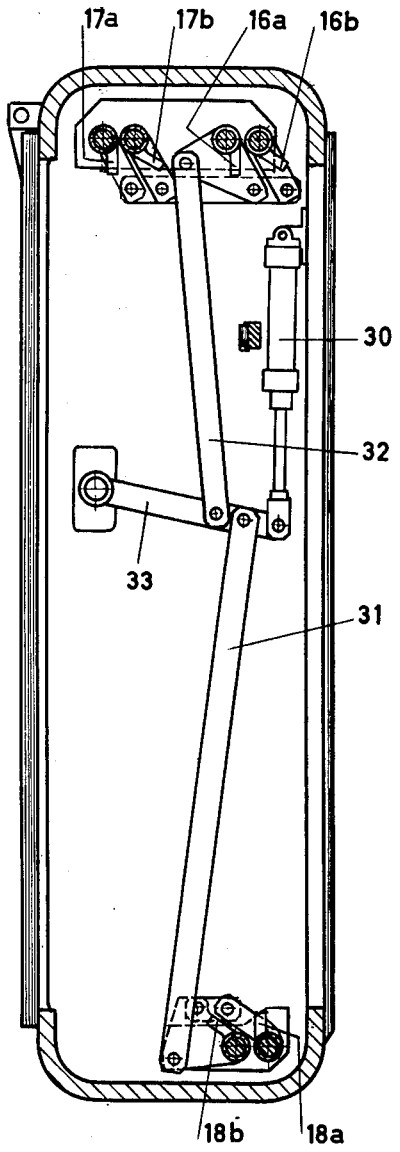

In FIGS. 7 and 8, the laterally displaceable separating walls are designated 19. The magazine is divided up into two compartments 3*a* and 3*b*, which are respectively provided with said feeding devices for the rounds. The compartments are separated by means of a separating wall 20 which is fastened to the rigid frame 13. The separating wall 20 is located opposite the breech ring of the firearm, and on the respective side of the wall a feed-out position for the rounds in the respective compartment is arranged. The rounds in the compartment 3*a* are thus transported towards the feed-out position at the left side of the separating wall 20, while the rounds in compartment 3*b* are transported towards the feed-out position at the right side of the separating wall 20 (see FIG. 7). As the lateral displacement goes on, the separating walls 19 are packed into a space at the respective feed-out positions. At the feed-out positions, the magazine is provided with hoisting devices 21 and 22. Said hoisting devices can be made to coact with the rounds in the innermost column, so that said rounds can be pressed through opening 23 or 24 up into the built-on part 12. The built-on part comprises lateral displacement devices 25 and 26, which move a round that has been pressed up into the built-on part 12 laterally to a position where, in the built-on part, ramming devices 27 can coact with the round. Said ramming devices comprise, among other things, a rammer tooth 28, which engages the cartridge case flange of the round.

FIG. 8, particularly, shows e.g. a hydraulic cylinder 29 for the transversal feeding teeth 18*a*. The turning movements of said holding and feeding teeth are particularly shown in FIG. 9, which comprises a hydraulic cylinder 30, by means of which the teeth are actuated via link arms 31–33.

The hoisting device 21 is shown in further detail in FIG. 5, and comprises a hoist cradle 34. The hoist cradle 34 is fastened to two link arms 35 and 36, and in rotatable shafts 37 and 38, respectively, which shafts are actuated by means of a hydraulic cylinder 39 via links 40, and 41 and 42, respectively. The hydraulic cylinder 39 is fastened to a rigidly arranged part 43, which also serves as a support for the lower round in the column, and in the links 40 and 42. The hydraulic cylinder 39 can have three positions, viz. the starting position shown in FIG. 5, a central position (indicated in FIG. 7) and an upper position where the lower round in the column in question goes into the built-on part 12.

The lateral displacement devices in the built-on part 12 are shown in FIGS. 6 and 7. As shown in FIG. 7, said parts comprise a horizontal part 25*a*, in addition to the vertically arranged part 25. In the horizontal part 25*a*, rotatable link arms 44 and 45 are arranged (see FIG. 6). Said arms, respectively, are rotatably supported at their middle parts in a vertical shaft 46, one end of the arm then being fastened in said horizontal part, and the other end to a hydraulic cylinder 47. The vertical part 25 of the device in question is intended to coact with a round pressed up into the built-on part 12. In addition to its laterally displacing function, the vertical part 25 also serves the purpose of guiding the rounds at the ramming.

In accordance with the above, the magazine body 13 is to follow the elevation movements of the firearm. The magazine body is therefore joined via a steering part in the form of a spring-action bridge 48 (see FIG. 6) extending between the firearm and the magazine. Said bridge 48 is fastened with joints to both the recoil jacket 49 of the firearm and the magazine body 13. For the jointing function at the firearm, the recoil jacket 49 is made with a forked fastener 50, into which the bridge 48 extends with a part 51, which part is supported in the forked part on a journal 52. The end surfaces facing each other of the forked part and the bridge are then chamfered so that the bridge, in the position shown in FIG. 5, is rigidly fastened in relation to the recoil jacket 49, for forces directed downwards on the magazine 3, but is fastened so that it can be folded up in relation to the recoil jacket 49 upon occurrence of upwardly directed forces on the magazine.

At its other end, the bridge 48 is arranged in the corresponding way, jointed to the magazine body 13. The magazine body is then made with protruding supporting lugs 53, in which are placed supporting journals 54 which coact with side recesses on said bridge 48. In the magazine body there is also fastened a lower supporting beam 55, which at the end turned away from the magazine can be in contact with a counter-holding surface on the bridge 48 in the position shown in FIG. 5. In this way, also this fastening point will be rigidly arranged for forces on the magazine acting downwards, but rotatable in response to upwardly directed forces on the magazine.

In accordance with FIG. 5, the built-on part 12, at the section facing the barrel, is provided with a cover 56, which can be folded up and which is rotatably supported at its upper parts. On its outside, the cover 56 has a cartridge case deflector 57, which is intended to deflect empty cartridge cases in a position where the cover is closed. In its turned up position, the cover 56 becomes connected with a cover 57 when this is in its turned up position. Another cover 58 is applied to the recoil jacket 49 of the firearm, and is arranged so that it can be opened and closed with, for instance, a hydraulic cylinder. The covers 56 and 58 join together in their turned-up positions to form a covered channel at the time of transfer of the rounds from the magazine to the chamber in the firearm, which contributes towards preventing foreign objects from entering into the magazine and at the firearm.

The ramming devices are known in themselves, and comprise a car 59 (see FIG. 6), at the ends of which chain wheels 60 and 61 (FIG. 5) are supported on horizontal shafts. On the chain wheels, a chain 62 is applied. One of the lower links of the chain is secured to the magazine 3. When the car 59 moves forwards or rearwards, the upper part of the chain 62 moves with twice the speed of the car. On one of the upper links of the chain 62, a ramming car 63 is mounted, with the rammer tooth 28, which is movable both horizontally and vertically. A hydraulic cylinder 64 supported in the magazine is fastened to the car 63 via its piston, whereby a ratio of 2:1 is obtained between the movements of the hydraulic piston and the rammer tooth 28. Said cars 59, 63 are placed to the right side of the rammer channel, and the rammer tooth 28 has been given the form of an angular arm.

The design shown of the ramming devices makes it possible to conceal the entire rammer in its starting position, at the same time as it can achieve a total ramming movement from the magazine position to the chamber position, as shown in FIGS. 5 and 6 with the reference designations provided with prime signs, 28', 61' and 63'. A round inserted in the chamber is designated 65, and the breech ring of the firearm is symbolized with 66. Said vertical movement of the rammer tooth permits the breech block in the breech ring to close at the same time as the rammer tooth presses against the bottom of the cartridge case.

The cover 56 on the built-on part is provided with an actuating arm 67, which can coact with a curve on the rammer, so that at the transfer of the round, the cover will assume an open position. The control of the cover 58 is coordinated with this movement of the cover 56. When the rammer is all the way in the magazine, the cover 56 is turned down, and the empty cartridge case can be ejected. When this function has been fulfilled, the cover 58 can also be closed, if no new round is to be rammed.

As shown in FIG. 7, the magazine body is made with two covers 68 and 69, located on the upper and lower sides, respectively, of the body. Said covers are arranged so that they can be blown out, i.e. they have great resistance towards external forces, but comparatively little resistance towards internal forces that can arise at, for instance, a fire in the magazine.

Through the location of the magazine, said covers 68 and 69 will contribute towards directing the effect of explosion forces, if any, so that little damage will be done to the tank. The upper covers 68 are moreover made so that they can be turned up, for instance over their front parts, so that the magazine can be loaded from above. When the upper magazine covers 68 are turned up, the side walls 19 are accessible so that they can be moved manually from the collecting space at the separating wall 20 to the respective place in the holding teeth. In this way, a simplified lateral feeding device is obtained.

Because of the heavy dimensions and the jointed fastening, the magazine can withstand great forces that arise when the tank is driven in reverse, into ditches etc. As regards the different compartments 3*a* and 3*b*, these are of different sizes, as the barrel is placed unsymmetrically in relation to the center line of the tank. The left magazine compartment 3*a* can, for instance, be loaded with 22 rounds, and the right magazine compartment can be loaded with 14 rounds. There are three possibilities of fetching rounds from the magazine, viz. from the left magazine compartment, from the right magazine compartment and from both magazine compartments alternatingly. For the operation and driving, electric and hydraulic power transmission is required from the tank to the magazine. Hydraulic pipes should appropriately be provided with automatic closing valves, which close in case of a rupture in the pipes. Said transmission is not shown in detail, since it can be designed in a way which is known in itself.

Manual ramming can be carried out from above through the hole at the rear of the tank. Another possibility is to have a hole made in the rear side of the magazine, through which hole a round can be placed in the ramming channel, and can thereby be rammed into the chamber.

The height of the magazine is comparatively small, as well as the ground clearance of the magazine. The upper side of the magazine is at a height of approx. 1.3 meters from the ground level.

The invention is not limited to the embodiment described above as an example, but can be subject to modifications within the scope of the following claims.

We claim:

1. A magazine for use on a tank having a large-caliber firearm, said magazine comprising a magazine body adapted to contain a plurality of rounds therein, said magazine body being separated from the tank chassis and being freely suspended on the outside of the tank at a position low on the tank at the rear end of said tank and in spaced relation to the tank chassis below the top of said chassis by means of at least one fastening member which extends between said magazine body and the rear end of said tank chassis, said fastening member being constructed to move flexibly relative to said tank chassis if said body should strike the underlying ground.

2. A magazine according to claim 1 wherein said firearm is mounted on the tank with rear parts of said firearm being located closely adjacent the rear end of the tank.

3. A magazine according to claim 1 wherein said fastening member comprises a jointed arm, and means for controlling the position of said arm to cause the magazine body to follow elevation and depression movements of said firearm.

4. A magazine according to claim 3 wherein said jointed fastening member is so constructed that forces applied to the lower side of said magazine body, due to contact of the magazine body with a foreign object, are operative to displace said magazine body upwardly relative to the firearm.

5. A magazine according to claim 1 wherein said fastening member consists of two arms each of which is fastened at one end thereof to the magazine body, the other ends of said arms being fastened to a supporting shaft.

6. A magazine according to claim 5 including a hydraulic cylinder connected to said arms for selectively moving said magazine body up and down relative to said tank chassis.

7. A magazine according to claim 1 including a spring-action bridge member located between the firearm and the magazine body, one end of said bridge member being flexibly fastened to the recoil jacket of the firearm, and the other end of said bridge member being flexibly connected to the magazine body.

8. A magazine according to claim 1 wherein said magazine body comprises a rigid frame fabricated of heavy armour plate having a thickness within the range of 15–100 mm.

9. A magazine according to claim 8 including at least one displaceable cover located on a side of said frame which does not face said tank chassis, said cover being mounted on said frame to withstand comparatively large external forces without displacement inwards of said frame but to give way for displacement outwards of said frame in response to comparatively small internal forces in the magazine.

10. A magazine according to claim 8 wherein said magazine body includes a housing part extending across the major portion of the width of the tank, said housing part being located on the upper side of said frame at a position opposite the breech ring of the firearm.

11. A magazine according to claim 1 wherein said housing part includes a separating wall fabricated of heavy armour plate positioned to divide the space within the magazine body into two separate compartments.

12. A magazine according to claim 11 wherein said magazine body is adapted to support the rounds in columns with two rounds in each column, separating walls within said magazine body for separating said columns of rounds from one another, said separating walls being adapted to be displaced laterally, and step-feeding members for selectively displacing said separating walls laterally thereby to transport said rounds from one location to another within the magazine.

13. A magazine according to claim 12 wherein each of said compartments includes a hoisting device therein adjacent said separating wall operative to coact with the rounds in the innermost column in said compartment, and means for activating said hoisting device to press a round up into said housing part via a recess located between said compartment and said housing part.

14. A magazine according to claim 13 including a cover for selectively closing the recess between said compartment and said housing part.

15. A magazine according to claim 13 including lateral displacement devices in said housing part operative to actuate a round inserted into the housing part laterally, and operative to guide the round to a ramming position.

16. A magazine according to claim 15 including ramming devices in said housing part for actuating a round which has been moved laterally by said lateral displacement devices.

17. A magazine according to claim 10 wherein said housing part, at the portion thereof facing the breech ring of the firearm, is provided with a cover arranged to be displaced when a round is fed out of said housing part.

18. A magazine according to claim 17 wherein said cover has a cartridge case deflector on its exterior side for deflecting empty cartridge cases.

19. A magazine according to claim 16 including a displaceable cover on said housing part facing the breech ring of said firearm, said ramming devices including means for guiding the displacement of said cover.

20. A magazine according to claim 15 wherein said lateral displacement devices include an angular member comprising a horizontal plate and an upright plate, and rotatable and hydraulically controlled arms fastened to said horizontal plate for moving said angular member, said upright plate being adapted to coact with one of said rounds.

* * * * *